US006042451A

United States Patent [19]

Feldman

[11] Patent Number: 6,042,451

[45] Date of Patent: Mar. 28, 2000

[54] DOLL SIMULATING ICE SKATING OR DANCING SPIN MOVES

[75] Inventor: Joseph B. Feldman, Los Angeles, Calif.

[73] Assignee: Mattel, Inc., El Segundo, Calif.

[21] Appl. No.: 09/133,891

[22] Filed: Aug. 14, 1998

[51] Int. Cl.[7] ..... A63H 3/00; A63H 11/00

[52] U.S. Cl. ..... 446/330; 446/236; 446/327; 446/353; 446/376

[58] Field of Search ..... 446/307, 322, 446/327, 330, 333–336, 352–354, 358–359, 365, 376, 379, 382, 390, 236

[56] References Cited

U.S. PATENT DOCUMENTS

| | | | |
|---|---|---|---|
| D. 380,507 | 7/1997 | Giordano et al. | D21/177 |
| 3,672,097 | 6/1972 | Gardel et al. . | |
| 3,700,384 | 10/1972 | Gardel et al. . | |
| 3,862,513 | 1/1975 | Isaacson et al. | 446/380 |
| 3,927,883 | 12/1975 | Bosley et al. | 446/334 |
| 4,040,206 | 8/1977 | Kimura . | |
| 4,186,516 | 2/1980 | Ensmann . | |
| 4,217,726 | 8/1980 | Flicker et al. . | |
| 4,279,419 | 7/1981 | Barnes et al. | 446/376 |
| 4,601,672 | 7/1986 | Cook et al. . | |
| 4,674,988 | 6/1987 | Kimondo . | |
| 4,676,764 | 6/1987 | Yeu . | |
| 4,702,350 | 10/1987 | Orii et al. . | |
| 4,968,280 | 11/1990 | Kelley . | |
| 4,992,070 | 2/1991 | Mullen et al. . | |
| 5,320,573 | 6/1994 | Matsuyama . | |
| 5,413,517 | 5/1995 | Kamijima . | |
| 5,558,555 | 9/1996 | Kennedy . | |

*Primary Examiner*—Sam Rimell
*Assistant Examiner*—Laura Fossum
*Attorney, Agent, or Firm*—Roy A. Ekstrand

[57] ABSTRACT

A doll includes a waist belt rotatably secured between upper and lower torso portions of the doll. A spring driven windup mechanism is supported within the upper torso of the doll and is operative to rotate the upper and lower torsos with respect to the waist belt. The waist belt further includes a pair of outwardly supported belt loops which may be used to hold the waist belt of the doll as the upper and lower torsos spin to simulate activities such as skating or dancing. In an alternate embodiment of the present invention, a cooperating support doll is configured to couple to the waist belt to simulate support typical of pairs skating or pairs dancing.

14 Claims, 5 Drawing Sheets

DOLL SIMULATING ICE SKATING OR DANCING SPIN MOVES

FIELD OF THE INVENTION

This invention relates generally to dolls and particularly to those which simulate skating or dancing activities.

BACKGROUND OF THE INVENTION

A great number of dolls and toy figures have been provided through the years which replicate activities such as skating or dancing. Both ice skating and roller skating activities have been replicated. In most such dolls, apparatus is provided for leg movement together with a balancing mechanism which seeks to simulate the movements of skating or dancing or the like. While many of these dolls perform well and appear to be skating or dancing or other activities such as walking and the like, little, if any, attention has been directed to simulating the twirling and spin maneuvers typical of skating or dancing. In most cases, those dolls which do attempt to provide twirling or spinning maneuvers are similar to "music box" type characters in that a stationary platform or base is provided for supporting the doll together with apparatus for rotating or spinning the doll upon the stationary base.

For example, U.S. Pat. No. 5,558,555 issued to Kennedy sets forth a SKATING DOLL PLATFORM having a base supporting an upright bearing and a shaft having an upper end which projects above the bearing and is clamped to one leg of the doll to support it above the base. The lower end of the shaft projects into the base and is joined to an actuator having an eccentric tip which frictionally engages the horizontal play surface and which is caused to rotate in various fashions as the base is moved about.

U.S. Pat. No. 5,413,517 issued to Kamijima sets forth an ACTION MECHANISM FOR DOLL having a base supporting a rotatable drive shaft extending upwardly therefrom. The rotating shaft is coupled to a doll to provide spinning movement of the doll.

U.S. Pat. No. 4,040,206 issued to Kimura sets forth a BASE AND ROTATABLY MOUNTED DOLL WITH RELATIVELY MOVABLE PART having a base and internal drive mechanism coupled to an upwardly directed small pedestal. The base drive mechanism rotates the small pedestal to rotate the doll. In addition, a drive shaft extends upwardly from the base pedestal and passes through apertures formed in a doll's leg. The upper end of the drive shaft supports a drive gear coupled to an arm moving mechanism housed within the doll torso.

U.S. Pat. No. 4,217,726 issued to Flicker et al sets forth a DOLL WITH MOVABLE LEGS, HEAD, TILTABLE TORSO having a first leg secured to the torso for pivotal movement relative thereto and the other leg hingedly coupled to the torso for pivotal movement about a fore-to-aft access. The head member is connected through gear devices to the first leg. Relative displacement between the first and second leg members may result in tilting the torso relative to the second leg member and rotating the head.

U.S. Pat. No. 4,968,280 issued to Kelley sets forth an ANIMATED FIGURE WITH INTERACTIVE HEAD AND TORSO having an upper and lower torso pivotally joined near the figure's waist. The head is pivotally secured to the neck portion of the upper torso. Arm and leg members are pivotally secured to the upper and lower torso portions, respectively. A gear drive and drive shaft mechanism is supported within the upper torso and is coupled between the lower torso and the head to provide rotation of the head in response to rotation of the lower torso.

U.S. Pat. No. 4,992,070 issued to Mullen et al sets forth a FINGER ACTUATED TOY FIGURE having a multiply jointed toy figure supporting finger attachments at its biceps and thighs which in turn receive the fingers of an operator allowing the doll to be animated by finger movement.

U.S. Pat. No. 4,674,988 issued to Kimondo sets forth a TWIRLING BREAK-DANCING TOY DEVICE having a main housing which supports a rotatable shaft defining an upper portion projecting outwardly therefrom. A coupling element is secured to the projecting shaft and is joined to an articulated doll. As the shaft is rotated, the spinning motion imparts action to the doll.

U.S. Pat. No. 4,676,764 issued to Yeu sets forth a DANCING DOLL WITH HIP MOVEMENT AND 180° ROTATION having a base supporting a drive mechanism which in turn rotates an angled shaft in a conical rotation. The angled shaft is received within one leg of an articulated doll resulting in hip movement as the shaft undergoes its conical travel.

U.S. Pat. No. 3,672,097 issued to Gardel et al sets forth a CRANK OPERATED DANCING DOLL having a torso formed of an upper portion and a lower portion in which the upper portion gyrates with respect to the lower portion. The doll's arms are articulated and swing alternately in a forward and back movement. The head also gyrates as the torso is moving.

U.S. Pat. No. 3,700,384 issued Gardel et al sets forth a BALLERINA DOLL having articulated limbs and simulating a ballet dancer. Leg and arm movement is synchronized to raise one leg while the arms are moving downward and to have the arms raised as the leg moves downward to a vertical position. Also included is a head spotting mechanism for controlling rotation of the head as a function of rotation of the torso.

U.S. Pat. No. 4,601,672 issued to Cook et al sets forth an ACTION FIGURE IN WHICH MANIPULATION OF ONE ARM PRODUCES ROTATION OF BOTH LEGS ABOUT A VERTICAL AXIS in which a doll includes an upper torso and lower torso rotatably coupled together with drive means responding to pivotal motion of a doll arm to provide rotation of the lower torso with respect to the upper torso.

In loosely related areas of the prior art, U.S. Pat. 4,702,350 issued to Orii et al sets forth a SPRING DRIVE DEVICE while U.S. Pat. No. 5,320,573 issued to Matsuyama sets forth a SPIRAL STRING TOY WITH A PULLING STRING having a spring driven pull-string wound drive apparatus for moving parts of the doll.

While the foregoing described prior art devices have improved the art, and in some instances enjoyed commercial success, there remains nonetheless a continuing need in the art for evermore interesting, novel, and amusing dolls which simulate the spinning and twirling activities of skating or dancing or the like.

SUMMARY OF THE INVENTION

Accordingly, it is a general object of the present invention to provide an improved doll. It is a more particular object of the present invention to provide an improved doll which simulates the spinning and twirling moves of skating or dancing in an entertaining and interesting fashion. It is a still more particular object of the present invention to provide an improved doll for simulating twirling moves of skating or dancing which interacts with a companion doll to simulate skating or dancing moves with the companion doll as a partner.

In accordance with the present invention, there is provided a doll comprising: a torso having legs extending downwardly, the legs each having a bottom portion, a waist belt rotatably supported upon the torso, and a rotational drive mechanism supported by the chassis and operatively coupled to the waist belt to rotate the torso with respect to the waist belt, the doll being constructed to be held by a user grasping the waist belt and holding the doll as it spins to simulate spinning and twirling moves typical of skating, dancing, or other similar activities.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, and in which:

DESCRIPTION OF THE PREFERRED EMBODIMENTS

Figure 1:
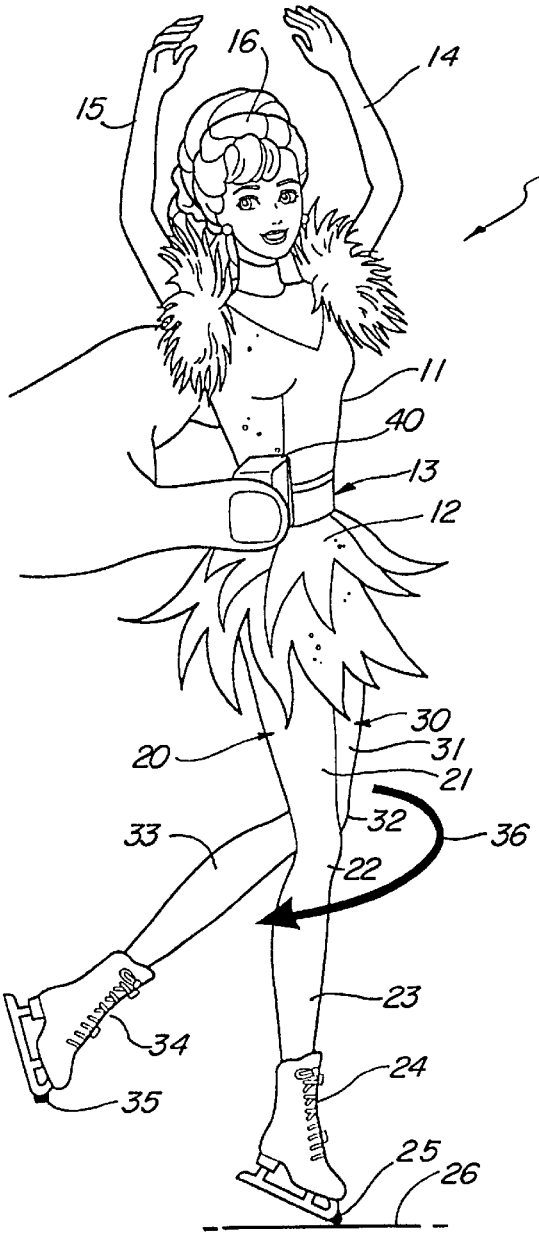
FIG. 1 sets forth a perspective view of a doll constructed in accordance with the present invention exercising an ice skating activity.

FIG. 1 sets forth a doll fabricated in accordance with the present invention and generally referenced by numeral 10. Doll is comprised of an upper torso 11 and a lower torso 12 joined by a rotating waist belt 13. As is better seen in FIG. 4, waist belt 13 is rotatable between upper torso 11 and lower torso 12 and includes a pair of belt loops 40 and 42 supported by outwardly extending links 44 and 45.

Returning to FIG. 1, doll 10 further includes a head 16, a pair of arms 14 and 15, and a pair of legs 20 and 30. Leg 20 includes a thigh portion 21, a knee portion 22, and a lower leg 23. Correspondingly, leg 30 includes a thigh portion 31, a knee 32, and a lower leg portion 33. In the embodiment of the present invention set forth in FIG. 1, which is that of a skating doll, lower legs 23 and 33 support simulated skates 24 and 34, respectively, each of which includes an extending frictional toe stop 25 and 35. Toe stops 25 and 35 are fixed upon skates 24 and. 34 and are preferably formed of a resilient molded plastic or rubber material having sufficient frictional characteristics to provide a frictional contact with a play surface such as surface 26. Knee portions 22 and 32 are fabricated in accordance with conventional fabrication techniques and are articulated allowing knees 22 and 32 to bend and maintain a posed position. For example, in FIG. 1, knee 32 is bent to position lower leg 33 in a raised angle position that differs from lower leg 23.

Figure 4:
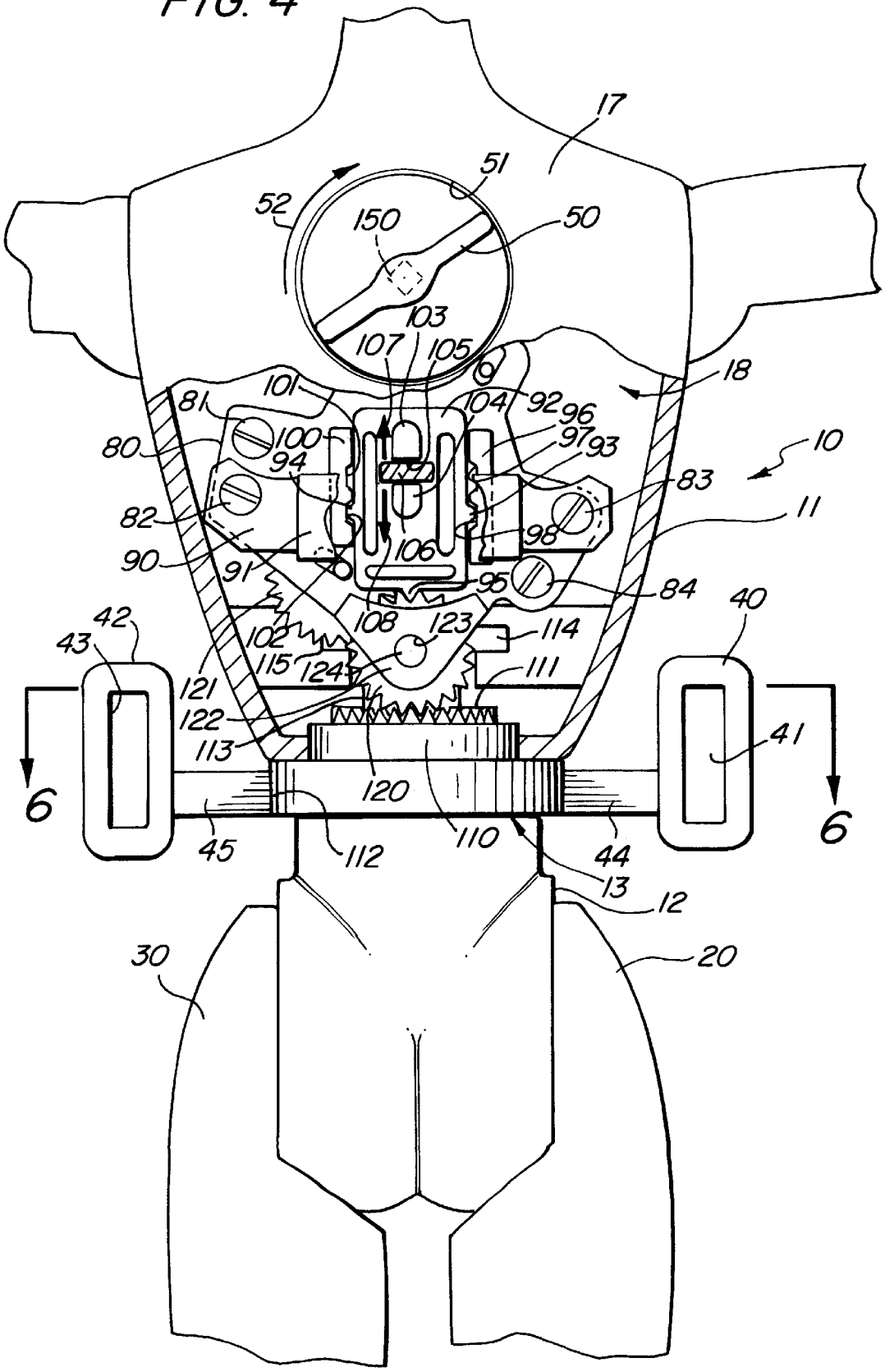
FIG. 4 sets forth a partially sectioned rear view of the present invention doll showing a portion of the drive mechanism for spinning.
Figure 5:
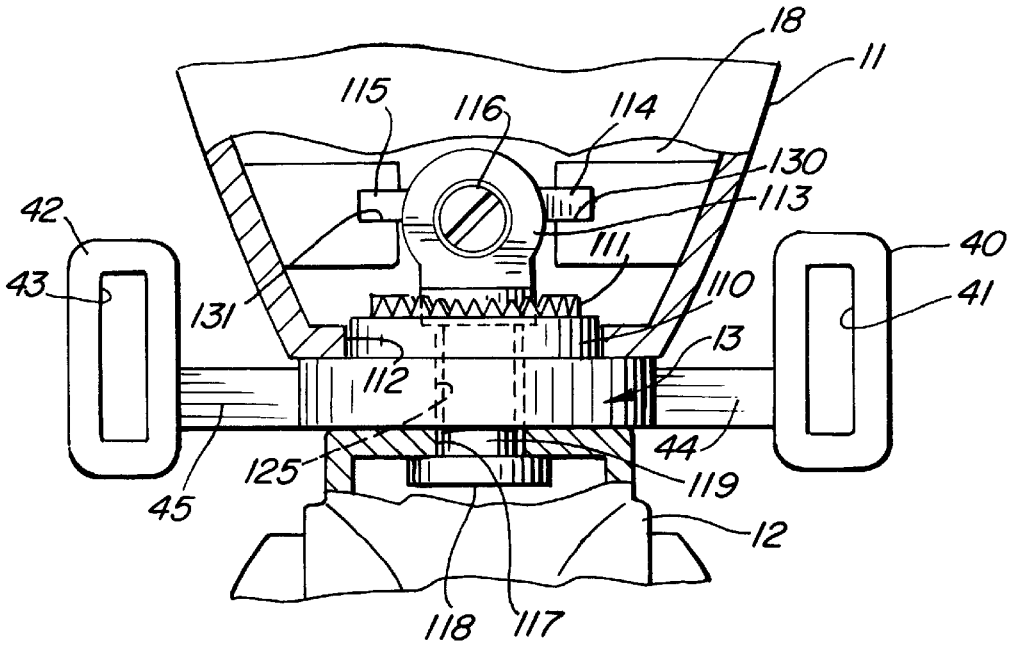
FIG. 5 sets forth a partially sectioned rear view of a portion of the drive mechanism of the present invention doll.
Figure 6:
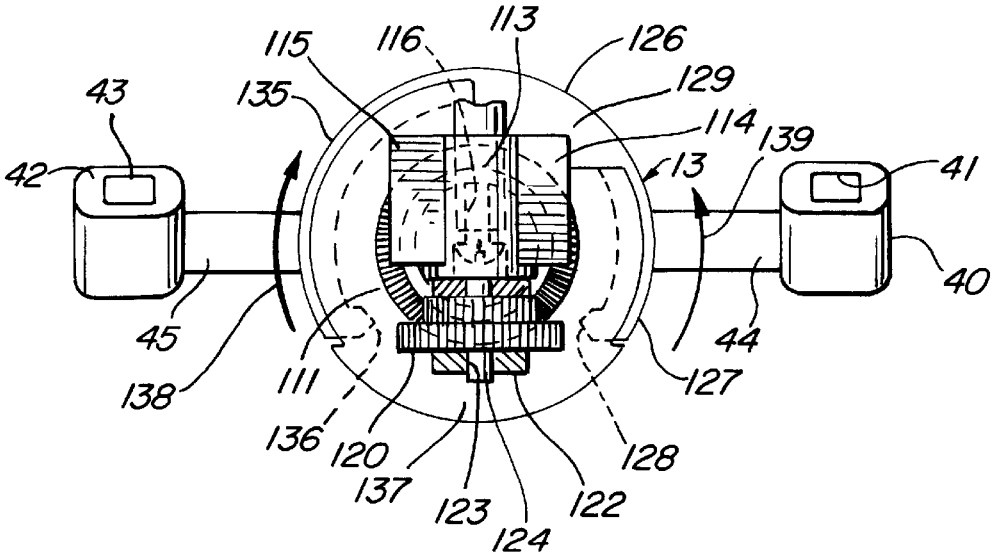
FIG. 6 sets forth a section view of the present invention doll taken along section lines 6—6 in FIG. 4.

By means set forth below in greater detail, doll 10 further supports a spring driven windup mechanism which rotates doll 10 with respect to waist belt 13. Thus in the anticipated play pattern of the present invention doll, this windup mechanism shown below in greater detail and particularly in FIGS. 4, 5, and 6, is utilized to store energy within its internal spring drive which is then released as the user holds belt loops 40 and 42. The energy stored in the spring drive mechanism rotates the doll in the direction indicated by arrow 36 while waist belt 13 and loops 40 and 42 (seen in FIG. 4) remain stationary in the user's grasp.

In accordance with the preferred embodiment of the present invention, legs 20 and 30 are pivotally secured to lower torso 12 using conventional fabrication techniques (not shown). As a result, the combination of pivotal attachment of legs 20 and 30 at lower torso 12, together with the bending or flexing characteristics of knees 22 and 32, facilitate substantial posing of doll 10 to increase the realism and amusement of the doll. It will apparent to those skilled in the arts that, with the exception of toe stops 25 and 35 on skates 24 and 34, waist belt 13 and belt loops 40 and 42 and the internal spring drive mechanism, doll 10 may be fabricated in accordance with conventional fabrication techniques. Thus arms 14 and 15 and head 16 may be conventionally fabricated of molded plastic material and the like.

Figure 2:
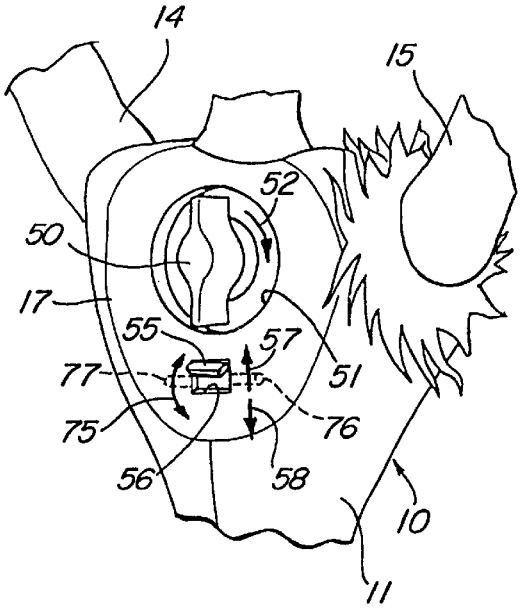
FIG. 2 sets forth a partial rear perspective of the upper torso of the doll of FIG. 1.

FIG. 2 sets forth a partial rear view of the upper torso portion of doll 10 showing the on/off button and the windup knob. More specifically, doll 10 includes an upper torso 11 preferably fabricated of a molded plastic material or the like supporting a pair of arms 14 and 15 and defining a rear surface 17. Rear surface 17 defines a recess 51 and a generally rectangular aperture 56. Within aperture 56 a pivotally supported lock button 55 is secured and extends outwardly through aperture 56. Lock button 55 is pivotable about a pair of pins 76 and 77 which in accordance with conventional fabrication techniques are supported within the interior of upper torso 11. A windup knob 50 is secured to a shaft 150 (seen in FIG. 7). By means set forth below in greater detail, pivoting lock button 55 upwardly about pins 76 and 77 moves the interior end of lock button 55 downwardly in the direction indicated by arrow 58 and, as is better seen in FIG. 4, locks slider 92 to gear 120 thereby preventing rotation of the doll. Conversely, movement of button 55 downwardly moves slider 92 (seen in FIG. 4) upwardly in the direction of arrow 57 to the release position allowing doll 10 to rotate.

Thus in operation, the user initially moves lock button 55 to the upward position to lock the windup drive mechanism and thereafter rotates windup knob 50 several turns in the direction indicated by arrow 52. This process stores energy within the internal spring drive mechanism of doll 10 which remains locked and stored until lock button 55 is moved downwardly in the direction indicated by arrow 58. The user then grasps doll 10 in the manner indicated in FIG. 1 and presses lock button 55 downwardly. The energy within the drive spring mechanism then rapidly twirls or rotates doll 10 to provide a twirling or spinning skater effect.

Figure 3:
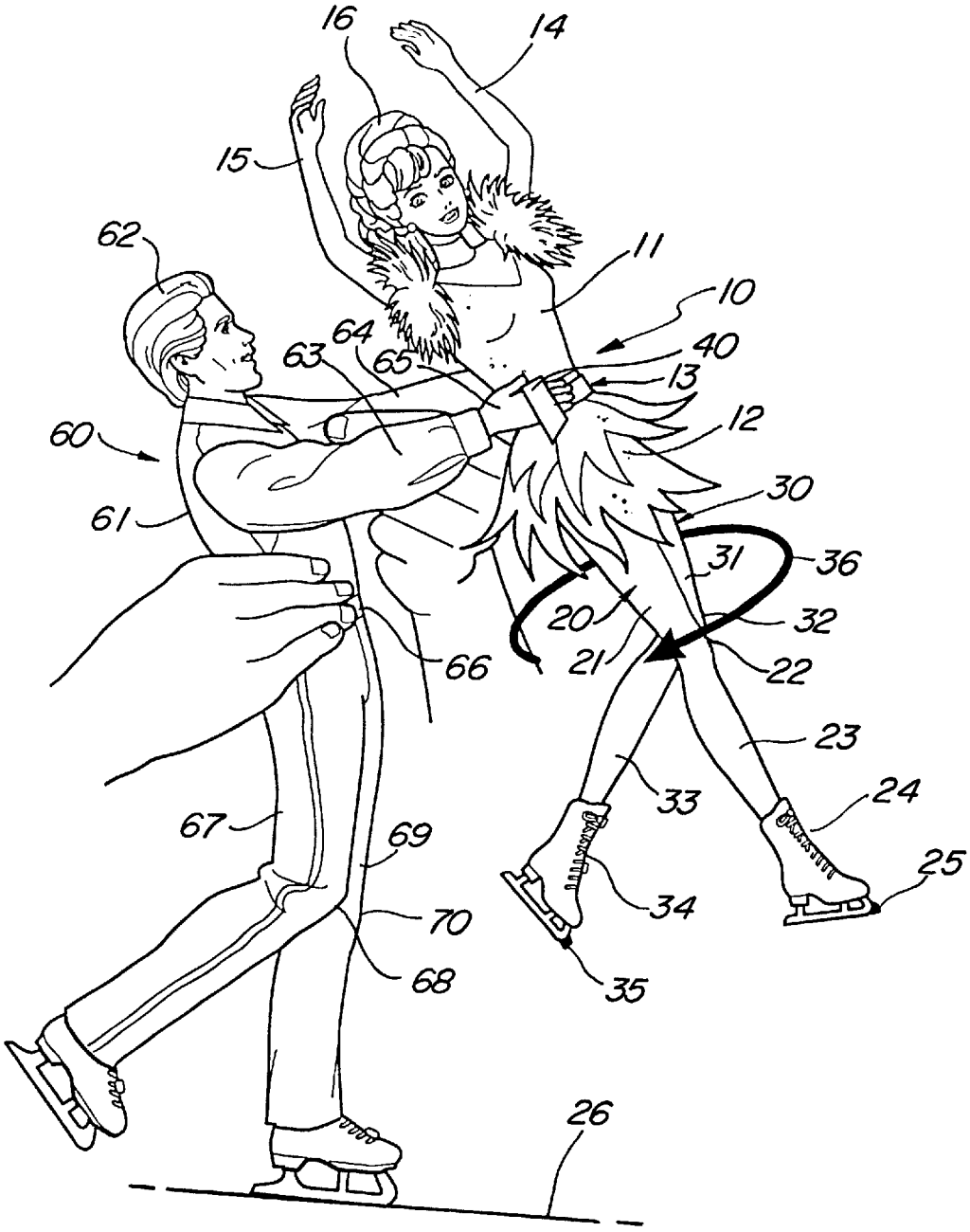
FIG. 3 sets forth a perspective view of a doll constructed. in accordance with the present invention together with an interactive partner doll.

FIG. 3 sets forth a side elevation view of the present invention doll cooperating with a section doll of similar stature and size to simulate the activities of a skating pair. As described above, doll 10 includes an upper torso 11 supporting arms 14 and 15 together with head 16. As is also described above, doll 10 includes a lower torso 12 and a rotating waist belt 13. Doll 10 further supports a pair of legs 20 and 30 having respective upper thighs 21 and 31, knees 22 and 32, and lower legs 23 and 33. In addition, doll 10 further supports simulated skates 24 and 34 having respective toe stops 25 and 35.

Doll 60 is fabricated to cooperate with doll 10 and preferably sized to correspond to a skating partner for doll 10. Thus doll 60 includes a torso 61 supporting a head 62 and a pair of arms 63 and 64. In the preferred fabrication of doll 60, arms 63 and 64 are pivotable at the shoulders thereof and each terminate in a forwardly extending hand such as hand 65 shown on arm 63. Doll 60 further includes a waist portion 66 and a pair of legs 67 and 69. Legs 67 and 69 preferably include bendable knees 68 and 70 fabricated in accordance with conventional fabrication techniques.

In the play pattern depicted in FIG. 3, the internal windup powered mechanism of doll 10 has been wound in the manner indicated in FIG. 2 and locked in the off position. Thereafter, doll 60 is mated to doll 10 by inserting the hands of doll 60 through apertures 41 and 43 (seen in FIG. 4) of waist belt 13. As can also be seen in FIG. 3, the user then grips doll 60 and supports doll 10 through the coupling to doll 60 at waist belt 13. With dolls 10 and 60 in this position, the user then releases lock button 55 and doll 10 rotates with respect to waist belt 13 as indicated by arrow 36.

The advantageous structure of the present invention provided by its ability to cooperate with a second doll such as doll 60 further improves the realism and amusement value of the present invention doll. The fabrication of doll 60 may be substantially, if not completely, conventional with the only requirement for performance with doll 10 being the ability to pivot the arms thereof and insert the doll's hands through apertures 41 and 43.

Figure 8:
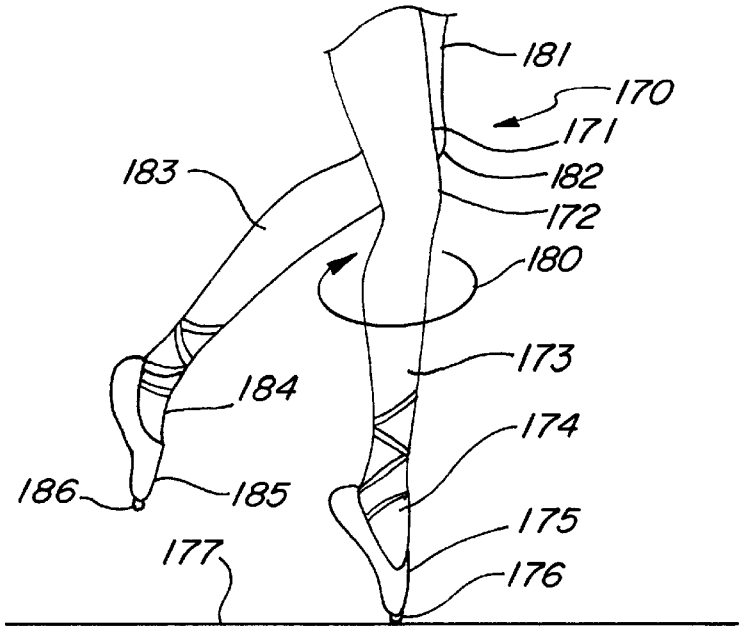
FIG. 8 sets forth a partial view of an alternate embodiment of the present invention doll.

It will apparent to those skilled in the art, from examination of FIGS. 1 through 3, that the present invention doll is not limited to a simulated ice skating doll but may utilize other action depictions such as ballet dancing or the like. Accordingly, it will be recognized by those skilled in the art that, for example, simulated ice skates 24 and 34 may be replaced with simulated ballet slippers with the rest of doll 10 operating in the manner described. This example is shown in FIG. 8 in which a ballet doll embodiment of the present invention is shown. It would be understood that the entire structure of doll 10 with the exception of skates 24 and 34 and ballet slippers 175 and 185 are fabricated in the same manner as described for doll 10.

FIG. 4 sets forth a partially sectioned rear view of doll 10 showing the windup drive mechanism and its cooperation with rotating waist belt 13. More specifically, doll 10 includes an upper torso 11 and a lower torso 12 together with a rotatable waist belt 13. In the preferred fabrication of the present invention, upper torso 11 and lower torso 12 may to some extent be pivotable or rotatable with respect to each other. However, in the preferred embodiment of the present invention, the entire combination of upper torso 11 and lower torso 12 is intended to rotate freely with respect to waist belt 13. Lower torso 12 supports legs 20 and 30 which, as mentioned below, are preferably joined to lower torso 12 using conventional pivotal hip or hip-to-leg attachment (not shown).

Upper torso 11 is fabricated of a molded plastic material or the like and is substantially hollow defining an interior cavity 18. Within interior cavity 18 a drive housing 80 preferably formed of a molded plastic material is secured by a plurality of fasteners such as fasteners 81, 82, 83, and 84. The structure of drive housing 40 is set forth below in FIG. 7 in greater detail. However, suffice it to note here that drive housing 80 supports a plurality of drive gears together with a windup spring powered mechanism which couples rotational power to gears such as gears 120 and 121. Thus gear 120 is supported upon a brace 122 by a shaft 124 received within aperture 123 of brace 122. As is set forth below in greater detail, gear 120 provides the output power gear for gear drive housing 80.

Drive housing 80 further supports a pair of vertically aligned parallel guides 96 and 100. Guide 96 defines a pair of detent notches 97 and 98 while guide 100 defines detent notches 101 and 102. A movable slider 92 defines a generally rectangular body having a pair of spaced apart posts 103 and 104 forming a gap 105 therebetween. Slider 92 further defines a downwardly extending lock projection 95 and a pair of outwardly extending detent projections 93 and 94. The function of slider 92 is to provide an on/off lock for the windup drive mechanism of the present invention doll. Accordingly, with slider 92 forced downwardly such that projections 93 and 94 are received within notches 98 and 102, lock projection 95 engages gear 120 and prevents rotation thereof. This effectively secures the drive mechanism and prevents operation of the doll. Conversely, with slider 92 raised in the direction indicated by arrow 107 to position projections 93 and 94 within notches 97 and 101, lock projection 95 is withdrawn from engagement with gear 120 leaving gear 120 free to rotate. With slider 92 thus positioned, power is freely transmitted through the windup drive mechanism to rotate gear 120. A flange 91 extends across and above slider 92 maintaining it within its sliding movement upon drive housing 80.

Gap 105 formed between posts 103 and 104 receives the interior end 106 of lock button 55 (seen in FIG. 2). Because of the above-mentioned pivotal movement of lock button 55, the movement of slider 92 is reversed from the relative movement of lock button 55. Accordingly, when lock button 55 (seen in FIG. 2) is pushed upwardly, end 106 moves slider 92 downwardly in the direction indicated by arrow 108 locking gear 120. Conversely, with lock button 55 pushed downwardly, slider 92 is raised in the direction indicated by arrow 107 withdrawing lock projection 95 from gear 120 and allowing the doll to operate.

In further accordance with the present invention and in the manner set forth in greater detail in FIGS. 5 and 6, lower torso 12 includes an upwardly extending bearing post 119 (seen in FIG. 5) having a fastener end 113 at the upper end thereof. By means also better seen in FIG. 5, fastener end 113 is secured to upper torso 11 using tabs 114 and 115. Waist belt 13 includes a pair of outwardly extending links 44 and 45 which in turn support generally rectangular belt loops 40 and 42. Apertures 41. and 43 formed in belt loops 40 and 42 are utilized in the above-described hand coupling illustrated in FIG. 3 by receiving the extended hands of the cooperating doll. Waist belt 13 is freely rotatable with respect to upper torso 11 and lower torso 12 and includes a bearing race 110 supporting an upwardly facing gear 111. Gear 111 engages output gear 120 of the gear drive mechanism supported within drive housing 80.

In operation, and with temporary reference to FIG. 2, lock button 55 is initially moved upward which, as described above, moves slider 92 downwardly in the direction of arrow 108 causing lock projection 95 to engage output gear 120. With slider 92 in this position, rotation of gear 120 is prevented. The user then rotates windup knob 50 in the direction indicated by arrow 52 which in turn rotates shaft 150 and the interior portion of spring 143 to store energy within spring 143 (seen in FIG. 7). Once a sufficient amount of energy is stored within the spring drive, the user then grasps belt loops 40 and 42 and thereafter pushes lock button 55 downwardly in the direction indicated by arrow 50 in FIG. 2. The downward movement of button 55 forces end 106 thereof upwardly in the direction indicated by arrow 107 moving slider 92 correspondingly and withdrawing lock projection 95 from output gear 120. Immediately upon the release of gear 120 from lock projection 95, the below described gear coupling mechanism causes gear 120 to rotate against gear 111 which in turn rotates the entire doll with respect to waist belt 13. The rotation of gear 120 continues until the energy stored within the windup spring is exhausted. Thereafter, the entire cycle is repeated by initially moving lock button 55 (seen in FIG. 2) upwardly to the locked position and again rotating windup knob 50.

FIG. 5 sets forth a partially sectioned rear view of doll 10 with drive housing 80 and its associated apparatus removed to better describe the rotatable coupling between waist belt 13 and upper torso 11 and lower torso 12. Thus as described above, upper torso 11 is substantially hollow defining an interior cavity 18. Similarly, lower torso 12 is substantially hollow and defines and upwardly facing aperture 117. A bearing post 119 includes a head 118 and is supported within aperture 117 to extend upwardly through waist belt 13 and bearing race 110 to join fastener end 113. To facilitate the extension of bearing post 119 through waist belt 13, a bore 125 is formed within waist belt 13 which is somewhat larger than bearing post 19 leaving waist belt 13 freely rotatable with respect to upper torso 11 and lower torso 112. Fastener end 113 receives a conventional fastener 116 for securing end 113 within interior cavity 18. Fastener end 113 further includes outwardly extending tabs 114 and 115, respectively, which are received within slots 130 and 131, respectively, formed in upper torso 11. The result is the freely rotatable support of doll 10 upon waist belt 13. It will be recalled that gear 111 formed on bearing race 110 is upwardly facing and (as is seen in FIG. 4) receives the rotational power of the drive mechanism to rotate the doll as waist belt 13 is held.

FIG. 6 sets forth a partially sectioned top view of doll 10 showing further details of the support structure for waist belt 13. More specifically, waist belt 13 supports a pair of outwardly extending links 44 and 45 which in turn support belt loops 40 and 42 having apertures 41 and 43 formed therein.

Waist belt 13 includes an upwardly facing gear 111 while upper torso 11 and lower torso 12 (seen in FIG. 5) are joined by an upwardly extending bearing post 119 (seen in FIG. 5) which passes through the center of gear 111 and which terminates in a fastener end 113. End 113 is secured within upper torso 11 by a conventional fastener 116. Tabs 114 and 115 extend outwardly from fastener end 113 further secure the fastener end. A shaft 124 rotatably supports a compound gear 120 upon brace 122 such that the outer gear of compound gear 120 engages upwardly facing gear 111 of waist belt 13.

In accordance with an important advantage of the present invention, waist belt 13 includes a waist plate 137 having a locating element 129. In further accordance with the present invention, waist belt 13 includes a waist clip 126 having curved spring clasps 127 and 135. Spring clasps 127 and 135 define inwardly extending tab 128 and 136, respectively, together with a locating element 129.

In operation, the combined structure of waist clip 126 and links 44 and 45 together with belt loops 40 and 42 may be removed from waist plate 137. In this manner, the present invention doll may be used in accordance with standard play patterns without the belt loops 40 and 42 being secured to the doll's waist. More specifically, the user removes belt loops 40 and 42 together with waist clip 126 by bending links 44 and 45 outwardly in the direction indicated by arrows 139 and 138 to separate tabs 128 and 136 from waist plate 137 and to open spring clasps 127 and 135. Once clasps 127 and 135 have been sufficiently opened, the combined structure may be removed from waist plate 137. The structure of belt loops 40 and 42, links 44 and 45, and waist clip 126 is assembled in essentially the reverse process by initially flexing links 44 and 45 as indicated by arrows 139 and 138 and replacing waist clip 126 upon waist plate 137. In this manner, doll 10 is usable in accordance with the present invention or alternatively may be used with the belt loops removed in a conventional play pattern.

Figure 7:
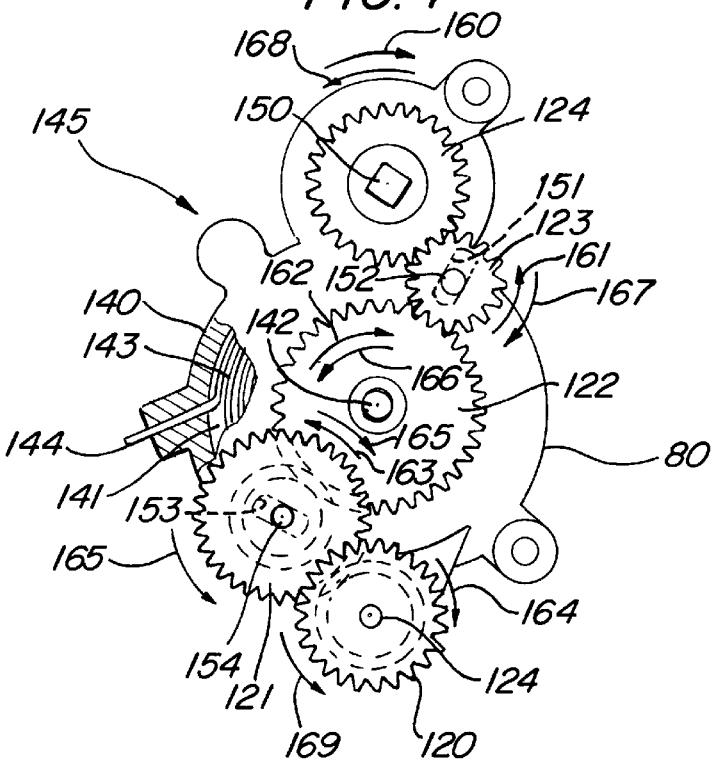
FIG. 7 sets forth a partially sectioned view of the gear drive mechanism of the present invention doll.

FIG. 7 sets forth a partially section view of the gear drive mechanism of the present invention generally referenced by numeral 145. Gear drive 145 includes a drive housing 80 preferably formed of a molded plastic material or the like and having a hollow spring drum 140 formed therein. Within drum 140, a coil spring such as a conventional clock spring 143 is supported and is secured at an outer end 144 to housing 80. The interior end of spring 143 is secured to a shaft 142 (in a conventional attachment not shown).

Gear drive 145 further includes a square shaft 150 which, it will be recalled, is coupled to windup knob 50 in the manner shown in FIG. 4. A gear 124 is secured to shaft 150 and rotatable in correspondence therewith. Gear 124 is coupled to a gear 123 having a shaft 152 movable within a slot 151 formed in drive housing 80. Gear drive 145 further includes a gear 122 engaging gear 123 and rotatably supported by a shaft 142. A compound gear 121 engages gear 122 and is rotatable upon a pin 154. Pin 154 is received within a slot 153 formed in gear drive housing 80. An output gear 120 is rotatable upon a shaft 124 and. is a compound gear having an interior portion engaging gear 121. It will be recalled that, as described above, the outer portion of gear 120 engages gear 111 of waist belt 13 (seen in FIG. 4).

In operation, the user locks gear 120 using slider 92 as described above (seen in FIG. 4). The user is then able to rotate shaft 150 using windup knob 50 (seen in FIG. 2) in the direction indicated by arrow 160. The rotation of shaft 150 produces a corresponding rotation of gear 124 in the direction of arrow 160 which in turn rotates gear 123 in the direction indicated by arrow 161. Gear 123 is movable within slot 151 and when thus rotated is driven into engagement with gear 122. The rotation of gear 123 causes gear 122 to rotate about shaft 142 in the direction indicated by arrow 162. As mentioned above, shaft 142 is secured to the interior end (not shown) of spring 143. Thus as gear 122 rotates shaft 142, spring 143 is wound to store energy therein.

The rotation of gear 122 in the direction indicated by arrow 162 rotates gear 121 in the direction indicated by arrow 163. Slot 153 allows pin 154 to move away from gear 122 when gear 121 is rotated in the direction indicated by arrow 163. Thus the gear coupling between gear 122 and output gear 120 is interrupted during the operation of winding spring 143.

In the operational cycle of gear drive 145, button 55 shown in FIG. 2 is moved to the released position and output gear 120 is no longer locked. As a result, the stored energy within spring 143 rotates shaft 142 and gear 122 in the direction indicated by arrow 166. Gear 122 in turn rotates gear 123 in the direction indicated by arrow 167 and gear 121 in the direction indicated by arrow 165. The support of gear 123 upon shaft 152 within slot 151 allows the coupling between gear 122 and gear 124 to be released during the unwinding process or during the winding of shaft 150 in the wrong direction. The support of gear 121 within slot 153 upon pin 154 allows gear 121 to be pulled into tight engagement between gear 122 and gear 120 when gear 121 is rotated in the direction indicated by arrow 165 during the power drive cycle of gear drive 145. As an end result, gear 120 is rotated in the direction indicated by arrow 169 which causes the above-described rotation of waist belt 13 (seen in FIG. 1).

FIG. 8 sets forth a partial perspective view of an alternate embodiment of the present invention doll generally referenced by numeral 170. Doll 170 is fabricated in the same manner as doll 10 described above and provides the same structure for rotating support. Doll 170 differs from doll 10 solely in the provision of simulated ballet shoes in place of the simulated ice skates of doll 10. More specifically, doll 170 includes legs 171 and 181 having knees 172 and 182 and lower legs 173 and 183. Doll 170 further includes feet 174 and 184 upon legs 171 and 181. A pair of simulated ballet slippers 175 and 185 extend downwardly from feet 174 and 184 and include frictional toe stops 176 and 186, respectively.

In accordance with the embodiment of the present invention shown in FIG. 8, the above-described cycle of winding the internal power drive mechanism to charge the doll with spring powered energy is carried forward after which doll 170 is allowed to rotate under spring power as described above in the direction indicated by arrow 180. Thus doll 170 illustrates the use of the present invention doll in an alternate activity such as ballet dancing.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll comprising:

a doll body including a torso formed from an upper and lower torso, the lower torso having legs extending downwardly therefrom, said legs each having a bottom portion;

a waist belt rotatably supported upon said torso, said waist belt extending around said torso, between said upper and lower torso; and a rotational drive mechanism supported within said doll body and operatively connected to said waist belt to rotate said doll body, including said upper torso, said lower torso and said legs together, with respect to said waist belt, said doll being constructed to be held by a user grasping said waist belt and holding said doll while said doll body rotates within said waist belt, thereby simulating spinning and twirling moves typical of skating, dancing, or other similar dolls.

2. The doll set forth in claim 1 wherein said legs each include a hip joint and a knee joint which allow said legs to be posed.

3. The doll set forth in claim 2 wherein said waist belt includes an upwardly facing gear and wherein said rotational drive mechanism includes a source of rotational power and an output gear engaging said upwardly facing gear.

4. The doll set forth in claim 3 wherein said rotational drive mechanism includes:

a drive spring secured at one end and coupled to a windup shaft;

a spring gear driven by said windup shaft; and a plurality of intermediate gears coupling said spring gear to said output gear.

5. The doll set forth in claim 4 wherein said rotational drive mechanism includes lock means for preventing rotation of said drive gear when locked and for allowing rotation thereof when unlocked.

6. The doll set forth in claim 5 wherein said waist belt includes a pair of belt loops supported on opposed side of said waist belt.

7. The doll set forth in claim 6 wherein said waist belt includes:

a waist plate having said upwardly facing gear; and a removable waist clip supporting said belt loops in a snap-fit attachment.

8. The doll set forth in claim 1 wherein said waist belt includes a pair of belt loops supported on opposed side of said waist belt.

9. The doll set forth in claim 8 wherein said waist belt includes an upwardly facing gear and wherein said rotational drive mechanism includes a source of rotational power and an output gear engaging said upwardly facing gear.

10. The doll set forth in claim 9 wherein said waist belt includes:

a waist plate having said upwardly facing gear; and a removable waist clip supporting said belt loops in a snap-fit attachment.

11. The doll set forth in claim 1 wherein said bottom portions of said legs are feet and articles of footwear.

12. The doll set forth in claim 11 wherein said articles of footwear are toy ice skates each having a simulated blade and a frictional toe stop.

13. The doll set forth in claim 11 wherein said articles footwear are toy dancing shoes each having a frictional toe stop.

14. A doll comprising:

a doll body including an upper and lower torso;

a waist belt rotatably supported on said torso, between said upper and lower torso, said waist belt including a pair of belt loops having apertures dimensioned and arranged to receive a pair of doll hands from a second doll; and drive means, coupled to said waist belt, for rotating said doll body, including said upper and lower torso together, relative to said waist belt;

said doll being constructed to be held by a pair of doll hands from a second doll being inserted into said belt loops of said waist belt, and allowing said doll body to spin within said waist belt.

* * * * *